US006987437B2

(12) United States Patent
Matsusaka et al.

(10) Patent No.: US 6,987,437 B2
(45) Date of Patent: Jan. 17, 2006

(54) ELECTROMAGNETIC ACTUATOR

(75) Inventors: Noboru Matsusaka, Kariya (JP); Hiroyuki Nakane, Okazaki (JP); Atsushi Iwase, Okazaki (JP)

(73) Assignee: Denso Corporation, Aichi-Pref. (JP)

( * ) Notice: Subject to any disclaimer, the term of this patent is extended or adjusted under 35 U.S.C. 154(b) by 0 days.

(21) Appl. No.: 10/397,252

(22) Filed: Mar. 27, 2003

(65) Prior Publication Data

US 2003/0184422 A1 Oct. 2, 2003

(30) Foreign Application Priority Data

Mar. 29, 2002 (JP) ..... 2002-096839
Dec. 20, 2002 (JP) ..... 2002-370696

(51) Int. Cl.
*H01F 7/08* (2006.01)

(52) U.S. Cl. ..... 335/220

(58) Field of Classification Search ..... 335/220
See application file for complete search history.

(56) References Cited

U.S. PATENT DOCUMENTS 4,832,516 A * 5/1989 Nagasawa et al. ..... 400/124.26
5,259,414 A * 11/1993 Suzuki ..... 137/625.65
5,779,220 A * 7/1998 Nehl et al. ..... 251/129.15
6,498,416 B1 * 12/2002 Oishi et al. ..... 310/214
6,501,359 B2 * 12/2002 Matsusaka et al. ..... 335/278
6,645,315 B2 * 11/2003 Chomer et al. ..... 148/217
2002/0057153 A1 * 5/2002 Matsusaka et al. ..... 335/220
2003/0042454 A1 * 3/2003 Kloda et al. ..... 251/129.15
2003/0089873 A1 * 5/2003 Modien ..... 251/129.15

FOREIGN PATENT DOCUMENTS

JP 63-184275 7/1988
JP 4-221810 8/1992
JP 04221810 A * 8/1992
JP 2001-332419 11/2000

* cited by examiner

*Primary Examiner*—Elvin G. Enad
*Assistant Examiner*—Bernard Rojas
(74) *Attorney, Agent, or Firm*—Nixon & Vanderhye P.C.

(57) ABSTRACT

An electromagnetic actuator has a movable core, a housing that holds the movable core so that the core may freely reciprocate, and an attractive part that applies a magnetic force to pull the movable core in one of the reciprocating directions. The electromagnetic actuator further has a stator that constitutes a magnetic circuit along with the movable core. At least one of the sliding faces of the housing and the movable core in contact with each other is subjected to gas soft nitriding, salt-bath soft nitriding, sulfo-nitriding, or nitriding treatment. The surface roughness of such a nitrided face is controlled to be within a prescribed range, so that the wear of the sliding faces of the movable core and the housing can be reduced.

10 Claims, 4 Drawing Sheets

ELECTROMAGNETIC ACTUATOR

CROSS REFERENCE TO RELATED APPLICATIONS

This application is based upon, claims the benefit of priority of, and incorporates by reference the contents of prior Japanese Patent Application No. 2002-96839 filed Mar. 29, 2002 and No. 2002-370696 filed Dec. 20, 2002.

BACKGROUND OF THE INVENTION

1. Field of the Invention

The present invention relates to electromagnetic actuators, and more specifically, to an electromagnetic actuator of which a housing of the movable core constitutes part of the magnetic circuit.

2. Description of the Related Art

As disclosed in Japanese Patent Laid-Open Publication No. 2001-332419, a known conventional electromagnetic actuator is equipped with a housing for holding a movable core so that it may freely reciprocate back and forth and a stator having an attraction part that exerts a magnetic attractive force on the movable core in either of the reciprocating directions. The stator is configured together with the movable core to form a magnetic circuit of magnetic flux produced by running electric current in the coil.

In the above type electromagnetic actuator however, the housing and the movable core slide directly in contact with each other, and therefore the wear of their sliding faces is a problem.

The inventors have found that Ni—P plating or Ni—P plating plus heat treatment on the sliding face of the movable core and gas soft nitriding of the sliding face of the housing, both for improving wear-resistance of the sliding faces, causes problems. Such an electromagnetic actuator equipped with a linear electromagnetic valve mechanism having the above surface-treated sliding faces may be employed in a hydraulic control valve that controls the hydraulic pressure of operation oil supplied to the hydraulic pressure control device of an automatic transmission of a vehicle. Then, although the operation oil pressure controlled by a coil current is within a demanding tolerance, the position of the movable core determined by the same coil current varies depending on the moving direction of the movable core. Additionally, a relatively large hysteresis (attractive force hysteresis) is observed.

As a result of an intensive study on the causes for such hysteresis, the inventors have discovered that a 1–2 $\mu$m thick porous layer is formed in the surface of the gas soft nitrided sliding face and that this porous layer causes the relatively large hysteresis.

In addition, if the electromagnetic actuator is used for a long time, the porous layer peels off, and sliding problems arise. In the electromagnetic valve disclosed in Japanese Patent Laid-Open Publication No. Hei. 4-221810, the movable ferrite core is nitrided (by tufftride treatment) to harden its surface and its surface roughness is raised by wrapping, in order to reduce friction with the guide material. Removal of the porous layer at random, however, will lower productivity. Through further investigation into this problem, the inventors have discovered that the amount of wear decreases significantly if surface roughness is 3.2 Rz or lower, as shown in FIG. 5, which describes the relationships between surface roughness and the amount of wear.

SUMMARY OF THE INVENTION

The present invention has been made with reference to such investigation, and an object of the present invention is to provide an electromagnetic actuator that can extend its life of use by hardening at least either of the sliding faces and to improve productivity by optimizing the level of surface roughness.

According to one aspect of the present invention, an electromagnetic actuator includes a movable core, a housing for holding the movable core so that the core reciprocates or shuttles freely, an attraction part for exerting on the movable core a magnetic force pulling the movable core in one of the reciprocating directions, and a stator for forming a magnetic circuit along with the movable core. Further, at least one of the sliding faces of the housing and the movable core in contact with each other is subjected to gas soft nitriding, salt-bat soft nitriding, sulfo-nitriding, or nitriding treatment. Finally, a surface roughness of the treated face is controlled to be within a prescribed range.

According to the above configuration, since the sliding face that has been nitrided by gas soft nitriding, salt-bath soft nitriding, sulfo-nitriding, or nitriding treatment is hardened and its surface roughness is controlled to be within a predetermined range, wear of the other sliding face can be reduced. Eventually, the wear of both sliding faces decreases. Then, the hysteresis becomes smaller, and in particular when such a device is adopted in a linear control type electromagnetic valve, the operation performance can be held high.

In the present invention, the surface roughness is preferably 3.2 Rz or lower. To keep the roughness level at 3.2 Rz or lower, the porous layer is removed after the surface has been subjected to gas soft nitriding, salt-bath soft nitriding, sulfo-nitriding, or nitriding treatment. Otherwise, the surface roughness is made 3.2 Rz or lower in advance before the gas soft nitriding, salt-bath soft nitriding, sulfo-nitriding, or nitriding treatment. The latter method is advantageous in that there is no need to remove any surface porous layer after gas soft nitriding, salt-bath soft nitriding, sulfo-nitriding, or nitriding treatment. Furthermore, since the surface roughness of the nitrided sliding face is optimized, the electromagnetic actuator can be manufactured with a minimum number of steps, and thereby productivity can be raised.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

The following description of the preferred embodiment(s) is merely exemplary in nature and is in no way intended to limit the invention, its application, or uses.

Figure 1:
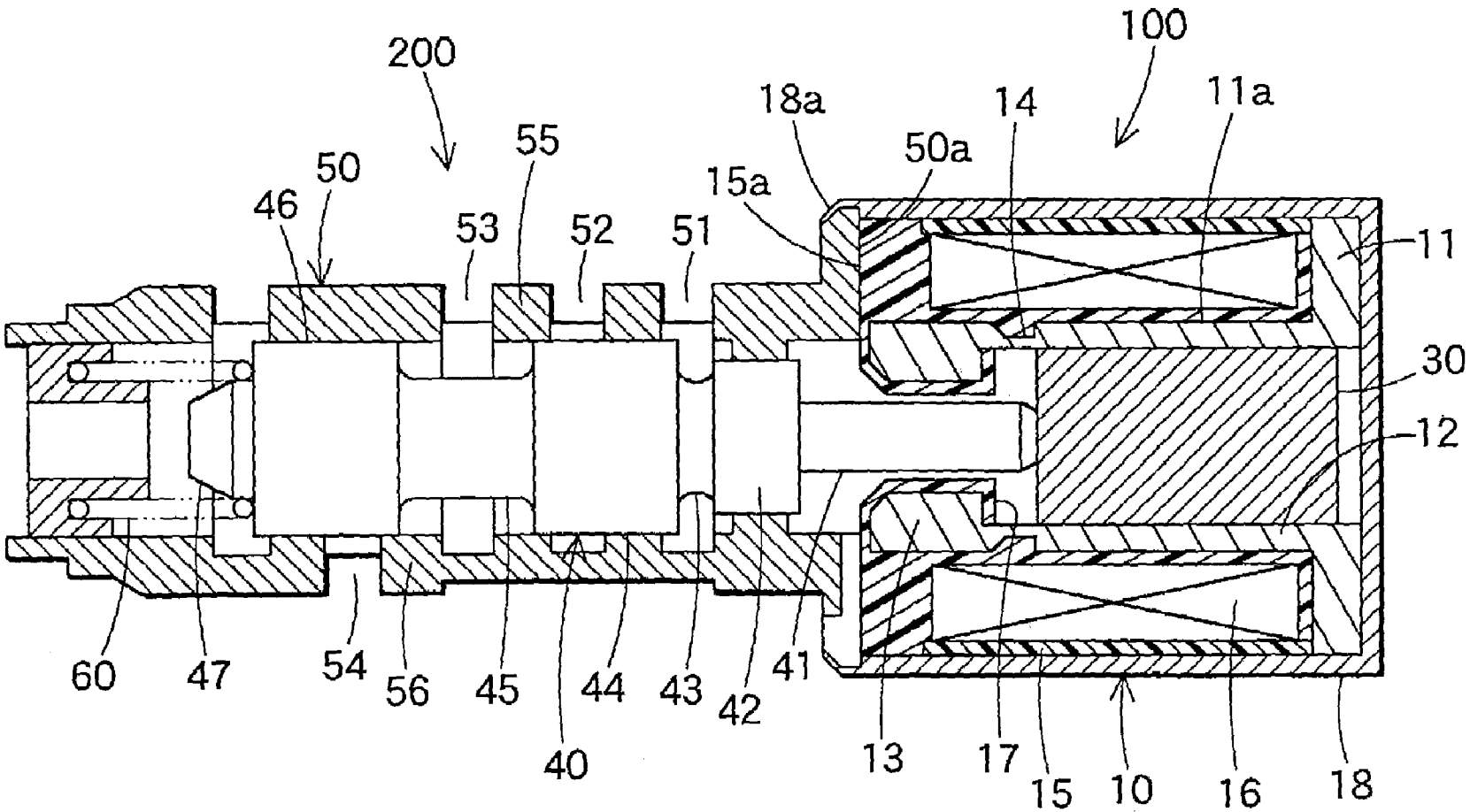
FIG. 1 is a cross-sectional view of a flow control device equipped with an electromagnetic actuator according to an embodiment of the invention.

Now the preferred embodiments of the invention will be described with reference to the accompanying drawings. FIG. 1 is a cross-sectional view of a flow control device equipped with an electromagnetic actuator according to an embodiment of the invention. This flow control device is, for example, a spool type hydraulic pressure control valve that controls the hydraulic pressure of operation oil supplied to the hydraulic pressure control device of an automatic transmission of a vehicle or the like.

Referring now to FIG. 1, the flow control device includes an electromagnetic actuator 100 and a valve unit 200.

(1) Electromagnetic Actuator 100

The electromagnetic actuator 100 constitutes a linear solenoid, equipped with a stator 10 and a cylindrical movable core (plunger) 30.

The stator 10 has a hollow stator core 11 that is made of magnetic material and is cylindrically shaped with a protruding portion at one end, much like a derby hat. The stator core 11 has a housing 12 that holds a movable core 30 so that the core 30 reciprocates freely in the lateral direction in FIG. 1, and an attraction part 13. This attraction part 13 extending from the housing 12 toward the valve unit 200 has an inner diameter smaller than the housing 12 and exerts a magnetic attractive force to the movable core 30.

Figure 2:
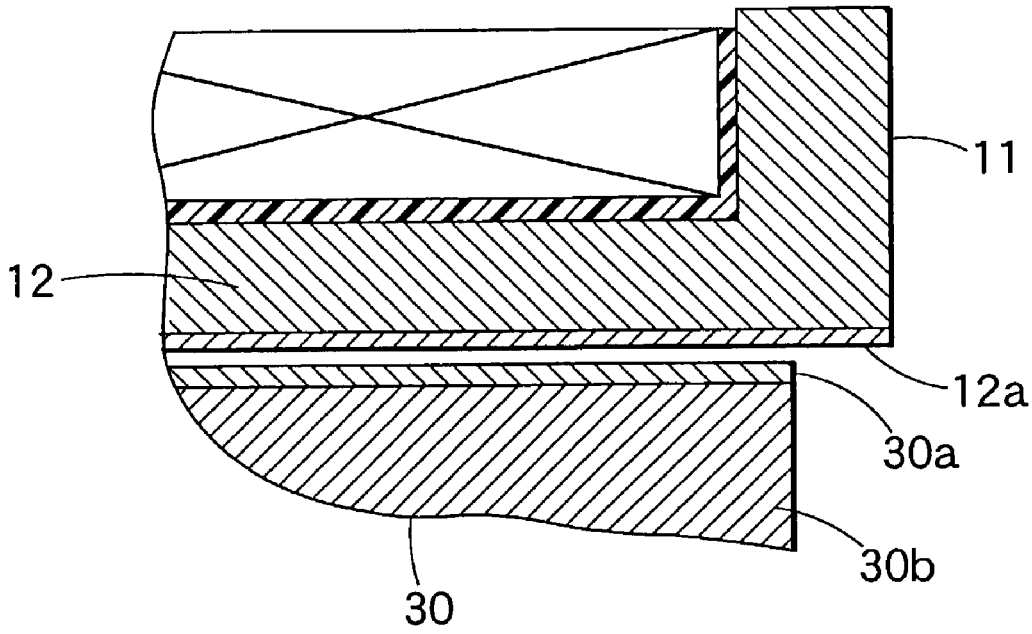
FIG. 2 is an enlarged cross-sectional view of the major part of a movable core and a stator core.
Figure 3:
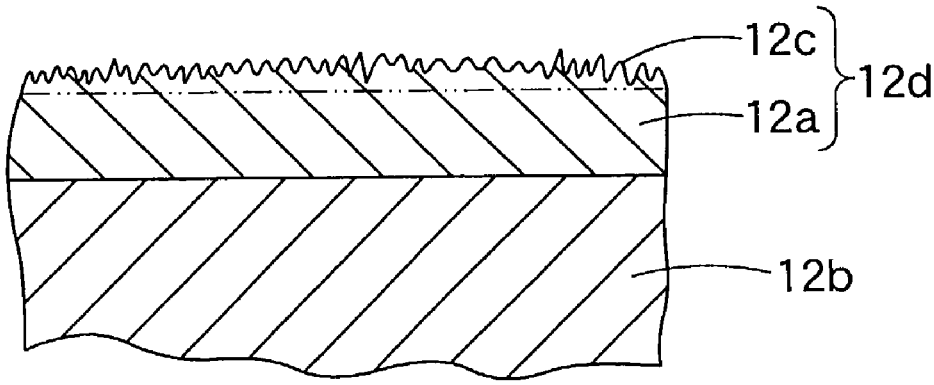
FIG. 3 is an enlarged cross-sectional view of a housing.

Referring now to FIG. 2, a non-magnetic layer 12*a* is formed in the surface of the housing 12. Referring to FIG. 3, the non-magnetic layer 12*a* is formed by subjecting a raw material of the stator core 11, for example, a ferrite core 12*b* having a hardness of about 1000 Hv to gas soft nitriding treatment (put the stator core 11 in a furnace of a nitrogen or ammonia atmosphere, and hold therein for a predetermined time, for example, 85 minutes, at a predetermined temperature, for example, 580° C. or lower) to form about a 7–20 $\mu$m thick nitride layer 12*d* of a hardness of about 1000 Hv in the surface of the ferrite core 12*b*, and then by removing the top surface of 1–2 $\mu$m thick porous layer 12*c* (layer above the chain double-dashed line in FIG. 3). Its surface roughness is controlled to be 3.2 Rz or lower.

The boundary between the housing 12 and the attraction part 13 is made thin, forming a magneto-resistance part 14 that ensures a magnetic attractive force of the attraction part 13 by limiting the amount of magnetic flux directed from the attraction part 13 to the housing 12.

A resin-molded component 15 is fastened by insertion molding to a concave portion 11*a* in the outer face of the stator core 11. A coil 16 is buried in this resin-molded component 15 to receive electric power from the outside via a connector (not shown). The resin-molded component 15 surrounds the attraction part 13, while its portion facing the movable core 30 constitutes a stopper 17 that restricts the movement of the movable core 30 in the direction toward the valve unit 200.

The stator core 11 and the resin-molded component 15 are housed in a yoke 18 that is made of magnetic material and is cylindrically shaped with a bottom. The open-end 18*a* of the yoke 18 is swaged, with the end face 15*a* of the resin-molded component 15 on the valve side being mated with the end face 50*a* of the housing (sleeve) 50 of the valve unit 200 on the resin-molded component side. The electromagnetic actuator 100 is thereby integrated with the valve unit 200.

A non-magnetic layer 30*a* is formed in the surface of the movable core 30, as shown in FIG. 2. The non-magnetic layer 30*a* is formed by subjecting a raw material of the magnetic movable core 30, for example, pure iron 30*b* to Ni—P plating, and a heat treatment to raise its surface hardness up to around 900 Hv. This heat treatment is not necessary.

In the electromagnetic actuator 100 above, if a current runs in the coil 16, a magnetic flux runs in the magnetic circuit composed of the yoke 18, the stator core 11 and the movable core 30 and pulls the movable core 30 leftward in FIG. 1 by a magnetic attractive force of the attraction part 13 of the stator core 11. The leftward movement of the movable core 30 is limited by the stopper 17. If the current to the coil 16 is shut down, the magnetic attractive force disappears, and the movable core 30 moves rightward in FIG. 1 due to a spring 60. This aspect will be described later.

When the movable core 30 reciprocates, the non-magnetic layer 30*a* of the movable core 30 and the non-magnetic layer 12*a* of the housing 12 slide in contact with each other.

(2) Valve Unit 200

The valve unit 200 includes a spool 40 whose axis lies in the line extending from the axial line of the movable core 30, a housing 50 that holds the spool 40 so that the spool 40 freely reciprocates in the lateral direction in FIG. 1, and a spring 60 that is installed in the end of the housing 50 and constantly pushes (biases) the spool 40 toward the movable core 30. The spool 40 disposed between the movable core 30 and the spring 60 has a rod 41 that projects into the electromagnetic actuator 100 and constantly contacts an end face of the movable core 30, a small land 42 axially extending from the rod 41, a small junction 43 whose diameter is smaller than that of the small land 42 for forming a feedback area (room), an input side large land 44 axially extending from the small junction 43, an output side small junction 45 axially extending from the large land 44 for forming an output area (room), a drain side large land 46 axially extending from the small junction 45, and a spring seat 47 axially extending from the large land 46.

The housing 50 has a feedback port 51 that opens up beside the outer face of the small junction 43 for forming the feedback room, an input port 52 that opens up beside the outer face of the input side large land 44, an output port 53 that opens up beside the outer face of the small junction 45 for forming the output room, and a drain port 54 that opens up beside the outer face of the drain side large land 46. The input port 52 is a port into which operation oil supplied from a tank (not shown) flows. The output port 53 is a port from which operation oil is supplied to an engaging device of the automatic transmission (not shown). The feedback port 51 is linked with the output port 53 in a certain place (not shown), and serves as a port through which part of the operation oil flowing from the output port 53 is introduced. The drain port 54 is a port through which operation oil is sent to the tank.

In the above configured valve unit 200, it is possible that no magnetic attractive force acts on the movable core 30, or, that is, the spool 40 does not receive a force from the movable core 30 when there is no current running in the coil 16 of the electromagnetic actuator 100. Instead, the spool 40 receives a force toward the movable core 30 applied by the spring 60 and a force toward the spring 60 applied by the feedback operation oil of the feedback port 51, based on the difference in area between the end of the input side large land 44 and that of the small land 42. Then the spool 40 is situated in the position where the two forces balance. The axial length of the housing wall 55 facing the input side large land 44 between the input port 52 and the output port 53, or the seal length, is shorter than a seal length provided when a current runs in the coil and the hydraulic pressures of the feedback operation oil are equal to each other. Thus the amount of operation oil flowing from the input port 52 to the output port 53 is large. Meanwhile, the axial length of the housing wall 56 facing the drain side large land 46 between the output port 53 and the drain port 54, or the seal length, is longer than that provided when a current runs in the coil and the hydraulic pressures of the feedback operation oil are equal to each other; and the amount of operation oil flowing from the output port 53 to the drain port 54 is small.

Since a magnetic attractive force works on the movable core 30 while a current is running in the coil 16, the spool 40 receives a force from the movable core 30 in addition to the forces of the spring 60 and the feedback operation oil. The spool 40 is situated in a position where the force of the spring 60 becomes equal to the sum of the force of the feedback operation oil and the force of the movable core 30. Then the axial length of the housing wall 55 facing the input side large land 44 between the input port 52 and the output port 53, or the seal length, is longer than that provided when no current runs in the coil and the hydraulic pressures of feedback operation oil are equal to each other; and the amount of operation oil flowing from the input port 52 to the output port 53 is small.

At the same time, the axial length of the housing wall 56 facing the drain side large land 46 between the output port 53 and the drain port 54, or the seal length, is shorter than that provided when no current runs in the coil and the hydraulic pressures of the feedback operation oil are equal to each other; and the amount of operation oil flowing from the output port 53 to the drain port 54 is large.

Meanwhile, when a current is running in the coil 16, the magnitude of magnetic attractive force acting on the movable core 30 is proportional to the magnitude of the current. Thus, when the hydraulic pressures of feedback operation oil are the same, the current is larger, the spool 40 is closer to the spring 60, the operation oil flowing from the input port 52 to the output port 53 is less, and the operation oil flowing from the output port 53 to the drain port 54 is greater.

As mentioned above, the non-magnetic layer 30*a* of a hardness of about 900 Hv is formed in the surface of the raw material 30*b* for the movable core 30 by applying Ni—P plating and, if necessary, heat treatment. The nitride layer 12*d* of a hardness of about 1000 Hv is formed in the surface of the raw material 12*b* for the housing 12 of the stator core 11 by applying gas soft nitriding. After this, the surface porous layer 12*c* is removed to form the non-magnetic layer 12*a*, and its surface roughness is controlled to be 3.2 Rz or lower. Methods for removing the porous layer include shot blasting in which small steel balls are accelerated onto the face to be hardened and the wrap finishing that polishes the target surface with abrasives.

Figure 4:
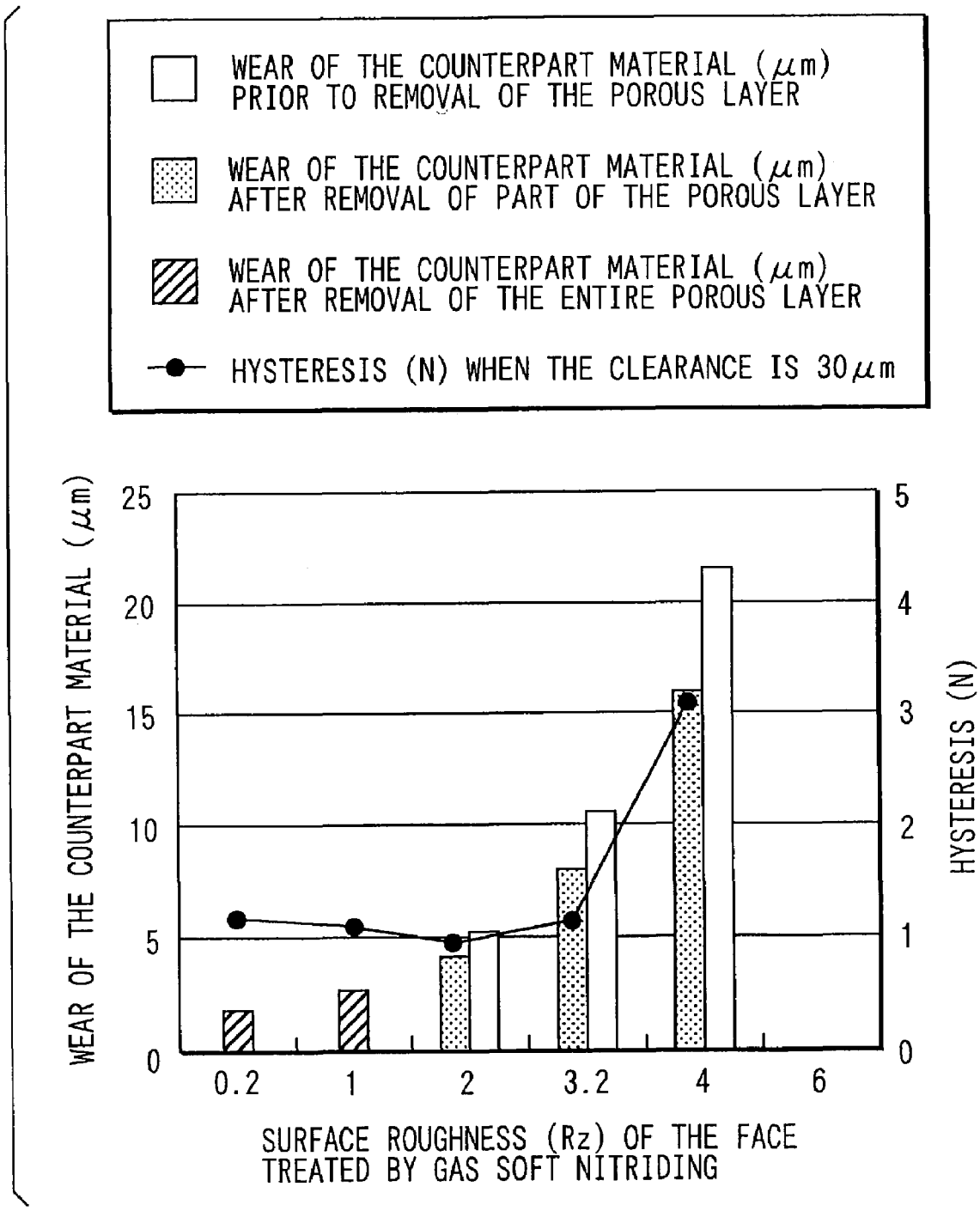
FIG. 4 is a graph showing the experimental data of the relationship between wear of the counterpart material and hysteresis with respect to the surface roughness of the sliding face hardened by gas soft nitriding.
Figure 5:
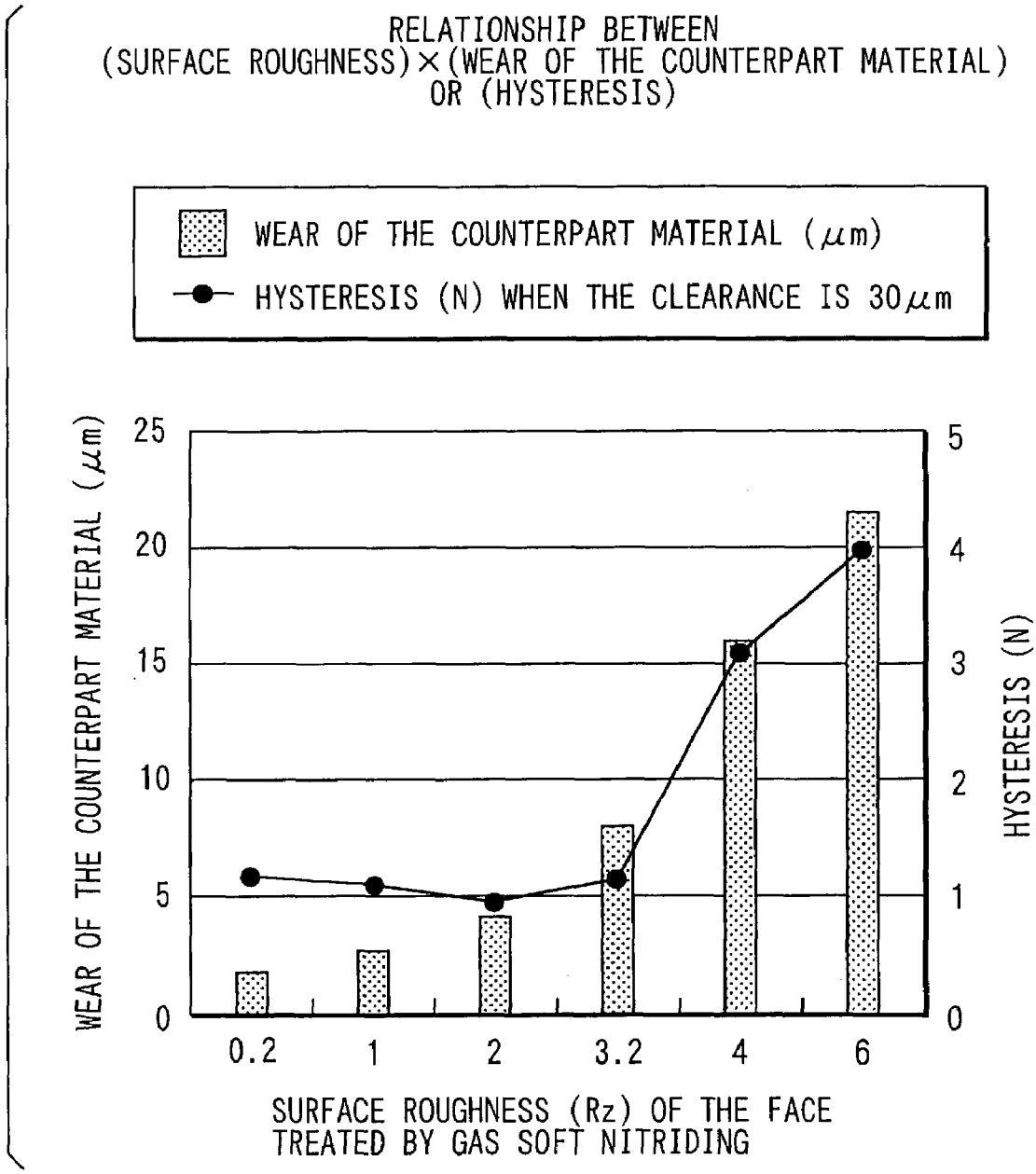
FIG. 5 is another graph showing the experimental data of the relationship between wear of the counterpart material and hysteresis with respect to the surface roughness of the sliding face hardened by gas soft nitriding.

FIG. 4 is a graph demonstrating the experimental data of the relationship between the wear of the counterpart material and hysteresis with respect to surface roughness of the sliding face hardened by gas soft nitriding. This wear of the counterpart material is the wear of the movable core 30 that has reciprocated 4 million times simulating 200 million meters of vehicle travel.

Referring to FIG. 4, the wear of the counterpart material 30 for the sliding face 12*a* produced by removing part of the porous layer 12*c* is less than that of the counterpart material 30 of the sliding face 12*d* from which the porous layer 12*c* has not yet been removed. However, the sliding face 12*d* still having the porous layer 12*c* meets the prescribed tolerance, for example, 12 μm, with a sufficient margin. When the clearance between the counterpart material 30 and the sliding face 12*d* or 12*a* hardened by gas soft nitriding was 30 μm, the hysteresis was about 6N when the surface roughness was 0.2 Rz and 1 Rz. When the surface roughness was 2 Rz, the hysteresis was about 5N. This indicates that the hysteresis does not become small when the surface roughness is made high.

According to the present embodiment, since the housing 12 of the stator core 11 is subjected to gas soft nitriding treatment, the hardness of the sliding face 12*d* is raised and the wear of the sliding face 30*a* of the counterpart material 30 can be reduced. When the surface roughness is made at 3.2 Rz or lower by removing the porous layer 12*c*, the attractive force hysteresis can be made smaller. By removing the porous layer, sliding problems due to peel-off of the porous layer 12*c* can be prevented.

In the above embodiment, the housing 12 of the stator core 11 is subjected to gas soft nitriding treatment, and its porous layer is removed. The movable core 30, instead, may be subjected to the same treatment. The surface roughness is not limited by the method chosen for removing the porous layer. Because the porous layer resulting from soft gas nitriding or sulfo-nitriding treatment is 1–2 μm thick, the roughness of the sliding face can be held at 3.2 Rz or lower by making the roughness of the sliding face at 3.2 Rz or lower prior to such surface hardening and then nitriding. Then, there is no need for removing the porous layer, and thereby productivity improves significantly.

Instead of gas soft nitriding treatment, salt-bath soft nitriding, sulfo-nitriding, or nitriding treatment can also provide a sliding face of a high hardness, low friction coefficient and little wear. In the salt-bath soft nitriding treatment, the steel material is immersed in a salt-bath held at about 500–600° C. to incorporate N and C therein for producing a nitride or carbide surface layer of a high hardness and low friction coefficient. In the sulfo-nitriding treatment, the top surface takes in N and C, or N, S and C to form a top surface of a high hardness and low friction coefficient. In the sulfo-nitriding treatment, since an iron sulfide layer of self-lubrication capability is formed in the surface, the resulting surface has a friction coefficient smaller than that of the surface obtained by the soft nitriding process. The nitriding treatment takes several times longer than the gas soft nitriding, salt-bath soft nitriding and sulfo-nitriding treatment. However, it can also produce a nitride surface layer with a high hardness and a low friction coefficient.

According to the present invention, one of the sliding faces is subjected to gas soft nitriding, salt-bath soft nitriding, sulfo-nitriding, or nitriding treatment. Then the hardness of the sliding face that has been subjected to such nitriding treatment is raised. In addition, the wear of the other sliding face can be reduced because the surface roughness is controlled to be within a prescribed range, and eventually the wear of both sliding faces can be reduced. As a result, the hysteresis becomes smaller and, in particular, when it is adopted in a linear control type electromagnetic valve, the operational performance can be held high. Because the roughness of a nitrided sliding surface is optimized, the electromagnetic actuator can be manufactured in a minimum number of steps and therefore productivity is improved.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An electromagnetic actuator comprising:

a movable core having at least one sliding face, that is subjected to gas soft nitriding, salt-bath soft nitriding, sulfo-nitriding, or nitriding treatment so that a surface roughness of the treated face is controlled to be within a prescribed range of 3.2 Rz and 2 Rz;

a housing having at least one sliding face, Ni-P plating or Ni-P plating plus heat treatment being provided to said at least one sliding face, wherein the housing encompasses the movable core so that the core reciprocates with the housing;

an attraction part, wherein the attraction part exerts a magnetic force on the moveable core to force the movable core in one of reciprocating directions; and a stator, wherein the stator forms a magnetic circuit along with the movable core, wherein at least one of said sliding faces of the housing and the movable core are in contact with each other.

2. The electromagnetic actuator according to claim 1, wherein the surface roughness is controlled to be within the prescribed range by removing a porous surface layer that forms on the treated face after said at least one of said sliding faces of the housing and the movable core, which are in contact with each other, is subjected to gas soft nitriding, salt-bath soft nitriding, sulfo-nitriding, or nitriding treatment.

3. The electromagnetic actuator according to claim 1, wherein the surface roughness is controlled to be within the prescribed range by removing a porous surface layer that forms on the treated face after said at least one of said sliding faces of the housing and the movable core, which are in contact with each other, is subjected to gas soft nitriding, salt-bath soft nitriding, sulfo-nitriding, or nitriding treatment.

4. The electromagnetic actuator according to claim 1, wherein at least one of the sliding faces of the housing and the movable core, which are in contact with each other, is 3.2 Rz or lower before undergoing gas soft nitriding, salt-bath soft nitriding, sulfo-nitriding, or nitriding treatment, thereby eliminating the need for a removal process of any porous surface layer that would otherwise form on the treated face, after such gas soft nitriding, salt-bath soft nitriding, sulfo-nitriding, or nitriding treatment.

5. The electromagnetic actuator according to claim 1, wherein said at least one of said sliding faces of the housing and the movable core, which are in contact with each other, is 3.2 Rz or lower before undergoing gas soft nitriding, salt-bath soft nitriding, sulfo-nitriding, or nitriding treatment, thereby eliminating the need for a removal process of any porous surface layer that would otherwise form on the treated face, after such gas soft nitriding, salt-bath soft nitriding, sulfo-nitriding, or nitriding treatment.

6. An electromagnetic actuator comprising:

a movable core having at least one sliding face, Ni—P plating or Ni—P plating plus heat treatment being provided to said at least one sliding face;

a housing having at least one sliding face, that is subjected to gas soft nitriding, salt-bath soft nitriding, sulfo-nitriding, or nitriding treatment so that a surface roughness of the treated face is controlled to be within a prescribed range of 3.2 Rz to 2 Rz wherein the housing encompasses the movable core so that the core reciprocates with the housing;

an attraction part, wherein the attraction part exerts a magnetic force on the moveable core to force the movable core in one of reciprocating directions; and a stator, wherein the stator forms a magnetic circuit along with the movable core, wherein at least one of said sliding faces of the housing and the movable core are in contact with each other.

7. The electromagnetic actuator according to claim 6, wherein the surface roughness is controlled to be within the prescribed range by removing a porous surface layer that forms on the treated face after said at least one of said sliding faces of the housing and the movable core, which are in contact with each other, is subjected to gas soft nitriding, salt-bath soft nitriding, sulfo-nitriding, or nitriding treatment.

8. The electromagnetic actuator according to claim 6, wherein the surface roughness is controlled to be within the prescribed range by removing a porous surface layer that forms on the treated face after said at least one of said sliding faces of the housing and the movable core, which are in contact with each other, is subjected to gas soft nitriding, salt-bath soft nitriding, sulfo-nitriding, or nitriding treatment.

9. The electromagnetic actuator according to claim 6, wherein said at least one of said sliding faces of the housing and the movable core, which are in contact with each other, is 3.2 Rz or lower before undergoing gas soft nitriding, salt-bath soft nitriding, sulfo-nitriding, or nitriding treatment, thereby eliminating the need for a removal process of any porous surface layer that would otherwise form on the treated face, after such gas soft nitriding, salt-bath soft nitriding, sulfo-nitriding, or nitriding treatment.

10. The electromagnetic actuator according to claim 6, wherein said at least one of said sliding faces of the housing and the movable core, which are in contact with each other, is 3.2 Rz or lower before undergoing gas soft nitriding, salt-bath soft nitriding, sulfo-nitriding, or nitriding treatment, thereby eliminating the need for a removal process of any porous surface layer that would otherwise form on the treated face, after such gas soft nitriding, salt-bath soft nitriding, sulfo-nitriding, or nitriding treatment.

* * * * *